US005309622A

United States Patent [19]

Pirchl

[11] Patent Number: 5,309,622

[45] Date of Patent: May 10, 1994

[54] PRESSING TOOL FOR THE PRODUCTION OF MULTILAYER FORMED PLATES

[75] Inventor: Gerhard Pirchl, Birrwil, Switzerland

[73] Assignee: AAW Produktions Aktiengesellschaft, Triesen, Liechtenstein

[21] Appl. No.: 381,419

[22] PCT Filed: Oct. 11, 1988

[86] PCT No.: PCT/CH88/00186

§ 371 Date: Aug. 15, 1989

§ 102(e) Date: Aug. 15, 1989

[87] PCT Pub. No.: WO89/03732

PCT Pub. Date: May 5, 1989

[30] Foreign Application Priority Data

Oct. 29, 1987 [CH] Switzerland ..... 4238/87-8

[51] Int. Cl.[5] ..... B24D 39/02

[52] U.S. Cl. ..... 29/566.1; 29/33 K; 29/565; 29/243.57; 29/DIG. 3; 29/243.5; 72/382

[58] Field of Search ..... 29/505, 509, 521, 897.32, 29/34 R, 565, 566.1, 650, 243.5, 243.57, 243.58, 281.3, 283.5, DIG. 3, 897.2, 33 K; 72/381, 382

[56] References Cited

U.S. PATENT DOCUMENTS

| | | | |
|---|---|---|---|
| 1,294,486 | 2/1919 | Kuen | 29/505 X |
| 2,041,004 | 5/1936 | Levan | 29/DIG. 3 X |
| 2,422,952 | 6/1947 | Dakin | 29/565 |
| 2,576,698 | 11/1951 | Russum | 29/509 X |
| 3,387,355 | 6/1968 | Herring | 29/565 X |
| 3,540,116 | 11/1970 | Drahos et al. | 29/509 X |
| 3,699,626 | 10/1972 | Roth | 29/243.5 X |

FOREIGN PATENT DOCUMENTS

| | | | |
|---|---|---|---|
| 1340894 | 9/1963 | France | 29/243.5 |

*Primary Examiner*—Joseph M. Gorski
*Attorney, Agent, or Firm*—Tarolli, Sundheim & Covell

[57] ABSTRACT

A compression molding tool comprises an upper part (3) and a lower part (2) connected by guides (4). A die (5) arranged in the lower part (3) of the tool cooperates with a force plug (6) arranged on the upper part (2) of the tool. The die (5) contains a mold cavity (7) the side walls of which are formed by two regions (12, 13). The outer region (13) of the side walls is inclined outward, i.e., divergent. A frame (14) guided on the columns (4) can be connected to the force plug (6) via a coupling device (15). Mounted on the frame (14) are spring-loaded elements (16) the free ends (17) of which cooperate with the inclined region (13) of the side walls of the mold cavity (7) in the die (5). The spring-loaded elements serve to produce a circular folded seam around the multilayer molded plates.

9 Claims, 3 Drawing Sheets

PRESSING TOOL FOR THE PRODUCTION OF MULTILAYER FORMED PLATES

TECHNICAL FIELD

The invention relates to a pressing tool for the production of multilayer formed plates with at least two outer layers. The pressing tool includes a tool lower part, a tool upper part, guide columns and a coupling device for driving the press. The lower part of the tool has a die with a forming hollow corresponding to the formed plate. The upper part of the tool has a pressing stamp fitting the forming hollow. The invention also relates to a process for the operation of such a pressing tool.

BACKGROUND ART

Pressing tools of this kind are generally known and are used, for example, in areas of sheet metal working, especially in the vehicle industry. The flat objects formed with these tools may include flat, curved or any desired combination of flat and curved surfaces. Multilayer formed plates which include, for example, two outer layers of sheet metal and an intermediate layer of insulation material, must be produced with several tools and in several work steps. The production of such multilayer formed plates is known in which a metal sheet, a covering foil, and the intermediate layer of insulation material are cut to the desired outer form. Each is prepared in separate work steps into a flat surface. These cut pieces are laid, in the desired construction order, into the forming hollow of a pressing tool and pressed into the desired form. Both outer layers of metal are cut larger than the insulation layer to produce a perfect joining in the rim portion of the formed plate between the individual layers of the formed plate. A metal cover foil overlaps the outer layer lying opposite. After the end of the form process, the metal cover foil must be laid manually around the outer layer lying opposite and pressed against the latter. Formed plates of this kind are used, for example in vehicle construction, as motor or exhaust pipe coverings. The production process described which requires, on the one hand, several tools, and on the other hand, a final manual finishing, is extremely costly and time-consuming. The use of automatic finishing instead of manual finishing of the rims is only possible to a limited extent, namely, only where a large enough number of pieces are needed. This is because multilayer formed plates of this kind have rim portions which are bent or curved in all spatial directions.

SUMMARY OF THE INVENTION

The invention addresses the problem of providing a pressing tool with which the layers of the formed plate may be formed, the edge portions of the outer layers trimmed as necessary, and with the same tool, the rim portion of one outer layer laid around the rim portion of the other outer layer, and the rim portions pressed together. The tool should make possible the production of multilayer formed plates without manual finishing and should be simple and economical to produce.

This problem is solved, according to the invention, by the fact the rim around the forming hollow includes side walls having two portions with different inclination toward the forming surface of the forming hollow. The first side wall portion abuts directly against the forming surface and is perpendicular to this forming surface.

The second upper side wall portion diverges outward. The upper part of the tool has a frame, movable along and arranged coaxially around the pressing stamp. A coupling device is arranged between this frame and the pressing stamp. Springs elastic elements are fastened to the Frame. The free ends of these spring elastic elements cooperate with the second diverging side wall portion of the forming hollow.

In another embodiment of the invention, the two side wall portions of the forming hollow run parallel to the curvature of the rim line of the forming surface. The free ends of the spring elastic elements form a line running parallel to the second upper side wall portion.

To allow the cutting of the rim portion of the outer layer of the formed plate, according to another embodiment of the invention, the lower part of the tool has the cutting plate arranged around the forming hollow. On the upper part of the tool is arranged a cutting stamp around the pressing stamp. The frame with the spring elastic elements is conducted between the pressing stamp and the cutting stamp. One preferred execution of the invention is distinguished by the fact that the cutting plate and the cutting stamp, in the zone of the cutting line, include a plurality of individual cylindrical cutting elements of polygonal cross-section. One cutting element each of the cutting plate and the cutting stamp form a pair, with cutting edges directed toward each other. In a further embodiment of the invention, the spring elastic elements are arranged against the cutting elements of the cutting stamp, and the frame and the cutting stamp form one construction unit. Another preferred embodiment of the invention is distinguished by the fact that the frame is connected with springs, and these springs press the frame against the upper part of the tool. In a further embodiment, the opening distance of the frame is limited by stops. At the upper dead point of the pressing stamp, the free ends of the spring elastic elements project beyond the end surface of the pressing stamp. In this position, the coupling device connects the frame with the pressing stamp.

Another preferred form of execution is distinguished by the fact that the spring elastic elements includes a plurality of rod-form strips arranged side-by-side. The spring elastic elements are made of metal or plastic. In the choice of material for the spring elastic elements, their elasticity and their material quality and the strength of the outer layer of the formed plate to be folded over should be considered. If the outer layer to be folded over is of aluminum foil, then spring elastic elements arranged tightly side-by-side and made of plastic are especially suitable. If an aluminum plate is used for the outer layer of the formed plate to be folded over, then the spring elastic elements are more suitably of spring steel In accordance with the combination of materials, still other spring elastic materials may be used.

One advantageous process for operation of the pressing tool, according to the invention, for multilayer formed plates includes laying the individual layers of the formed plate between the upper and lower parts of the tool and then, by pressing the two parts of the tool together, forming the formed plate. The distinction is that, simultaneously with the forming of the plate, the overlapping edge of an outer layer is at least partly laid around the edge of the second outer layer. The tool is completely opened again, and the frame is solidly joined with the pressing stamp by means of the coupling device. Then the two parts of the tool are moved together again, while the elastic elements are turned inward against the diverging portions of the side walls of the forming hollow, and the edge of the first outer layer is completely laid around the edge of the second outer layer by means of the elastic elements. Then the tool is opened again, and the frame is uncoupled from the pressing stamp. In another execution, the process is distinguished by the fact that before the end of the forming process of the plate, the edge of the first outer layer is trimmed in the same work step. Preferably, after the complete folding over of the edge of the first outer layer, the pressing tool is closed again and the formed plate and its edge are completely pressed.

The advantages attainable with the invention include, in particular, the fact that multilayer formed plates, after laying the individual layers into the pressing tool, can remain in the same tool for complete finishing and production, and that all the necessary work steps can be carried out with this tool. With this, the formed plates have a good form stability and a good clamping connection of the edge portion of the outer layers. Unlike manual laying of the outer layer around the edge portion thicker sheet metal may also be used as outer layers and folded over because of the high tool forces possible. The multilayer formed plates can be produced much faster and more economically than with methods and tools known heretofore. By the use of a plurality of individual cutting elements for the production of cut edges, even very complicated outer forms can be produced more simply and economically. For this purpose, these individual cutting elements are simply arranged along the desired outer contour of the formed plate, and are joined with the cutting plate or cutting stamp by casting, gluing or other known joining methods. With this arrangement, no expensive and complicated cutting rings are needed. This leads to a further cost advantage.

BRIEF DESCRIPTION OF THE DRAWINGS

The invention will be explained in detail below from examples of execution with reference to the attached drawings.

DESCRIPTION OF A PREFERRED EMBODIMENT

Figure 1:
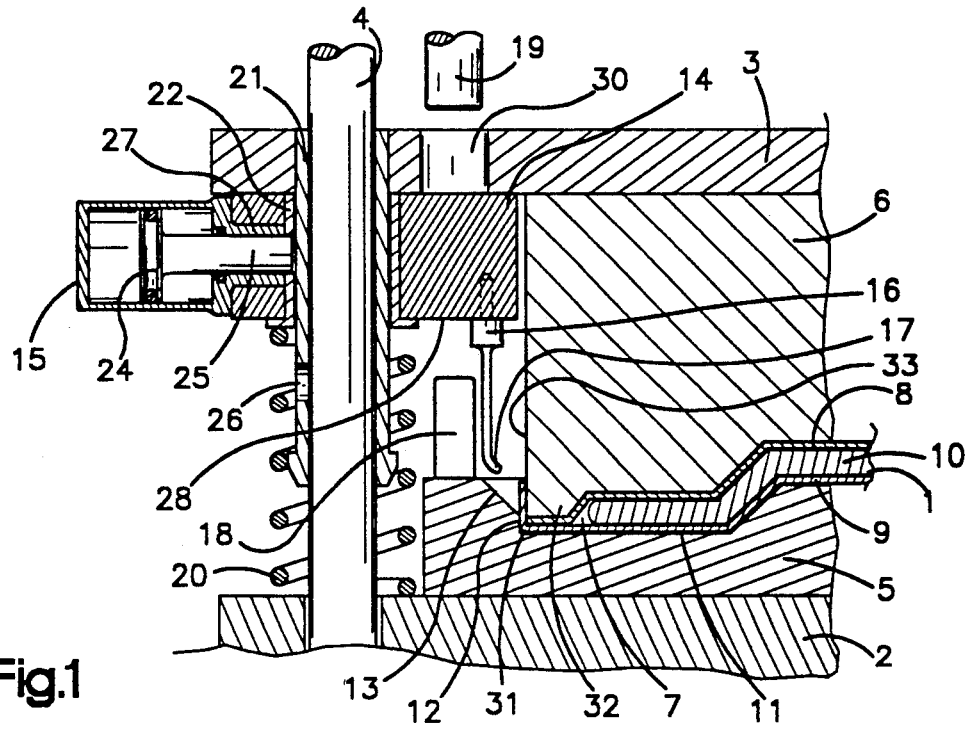
FIG. 1 shows a partial section through a pressing tool with forming plates laid in and upper and lower tool parts run together.

The pressing tool according to FIG. 1 includes a tool lower part 2 and a tool upper part 3 connected with each other by several guide columns 4. As a rule, the guide columns 4 are anchored in the lower part 2 of the tool, and the upper part 3 of the tool is movable in the direction of the longitudinal axis of the guide columns 4. For this purpose, guide bushings 21 are fastened in the upper part 3 of the tool and enclose the guide columns 4. The upper part 3 of the tool is joined by couplings and movement devices for the driving of the press (not shown), and has other devices (also not shown) for the stop limitation and holding of auxiliary means. The total structure of the tool may be varied in the known way from the partial section in FIG. 1. The size of the tool depends on the total extent of the plate 1 to be formed. The section shown in FIG. 1 extends through the edge portion around the circumference of the whole tool.

The multilayer formed plate shown in FIG. 1 is a heat-insulation plate for covering exhaust pipe parts of combustion engines. The formed plate 1 includes a first outer layer 8 of aluminum sheet metal, a mat 10 of insulation material, and a second outer layer 9 of a thin aluminum foil. The insulation material 10 is smaller in the edge portion than the 2 outer layers 8, 9, while in the example shown, the outer layer 8 of sheet aluminum is smaller, in turn, than the outer layer 9 of aluminum foil. In the formed condition of the formed plate 1, the two outer layers 8, 9 are pressed against each other in the outer portion, and the edge of the outer layer 9 is folded or turned around the edge portion of the outer layer 8. The strength of the outer layer 9 of aluminum foil is so chosen that the folding of the outer portion provides a perfect connection of the individual layers of the formed plate 1, and that the outer layer 9 also retains the curvatures of the formed plate 1 after the forming.

The lower part 2 of the tool has a die 5 with a forming hollow 7. As counterpart to the forming hollow 7, a pressing stamp 6 is arranged on the upper part 3 of the tool. The pressing stamp 6 has an end surface 32 corresponding in form to the forming hollow 7. The spatial dimensions of the forming hollow 7 are defined by the forming surface 11 which determines the spatial form of the formed plate 1. The border includes side wall portions 12, 13. The first side wall portion 12 abuts directly against the edge line 31 of the formed surface 11 and is perpendicular to the formed surface 11. The height of the side wall portion 12 corresponds to the thickness of the folded edge portion of the two outer layers 8, 9. The first side wall portion 12 is adjoined by a second side wall portion 13 which is inclined outward and forms a divergent opening of the forming hollow 7. In the example shown, the side wall portion 13 has an inclination of 45° from the axis of movement of the upper part 2 of the tool. The two side wall portions 12, 13 run parallel to the edge line 31 of the forming surface 11. During the pressing of the formed plate 1, the outer layer 9 is drawn over the oblique side wall portion 13, and at the end of the pressing process, is erected between the first perpendicular side wall portion 12 and the wall surface 33 of the pressing stamp 6. The pressing stamp 6 and the forming hollow 7 are arranged with suitable play between them.

A frame 14 is arranged around the pressing stamp 6 and can be moved along in relation to the upper part 3 of the tool. For this purpose, the frame 14 is supported by guide bushings 21, 22 sliding on the guide columns 4. Spring elastic elements 16 are fastened to the lower surface 28 of this frame 14 in the zone of the wall surface 33 of the pressing stamp 6. The spring elastic elements 16 form a plurality of rod-form strips which are arranged closely side-by-side and which have free ends 17. The free ends 17 of the spring elastic elements 16 form a line running parallel to the second upper side wall portion 13 of the forming hollow 7. A spring 20 presses the frame 14 against the upper part 3 of the tool and prevents the spring elastic elements 16 from cooperating with the die during the pressing process. A coupling device 15 makes possible, in definite work steps, the form-fitting connection of the frame 14 with the upper part 3 of the tool. The coupling device 15 includes a known piston-cylinder unit 24 with pressure medium feeds and control elements, not shown. A coupling pin 25 is guided in a bearing bushing 27 of the frame 14, and is in the starting position during the pressing process. In the guide bushing 21, a coupling bore 26 is solidly connected with the upper part 3 of the tool. The bore 26 is arranged in the lower portion of the guide bushing 21 and has the same dimensions as the coupling pin 25 of the coupling device 15.

Figure 2:
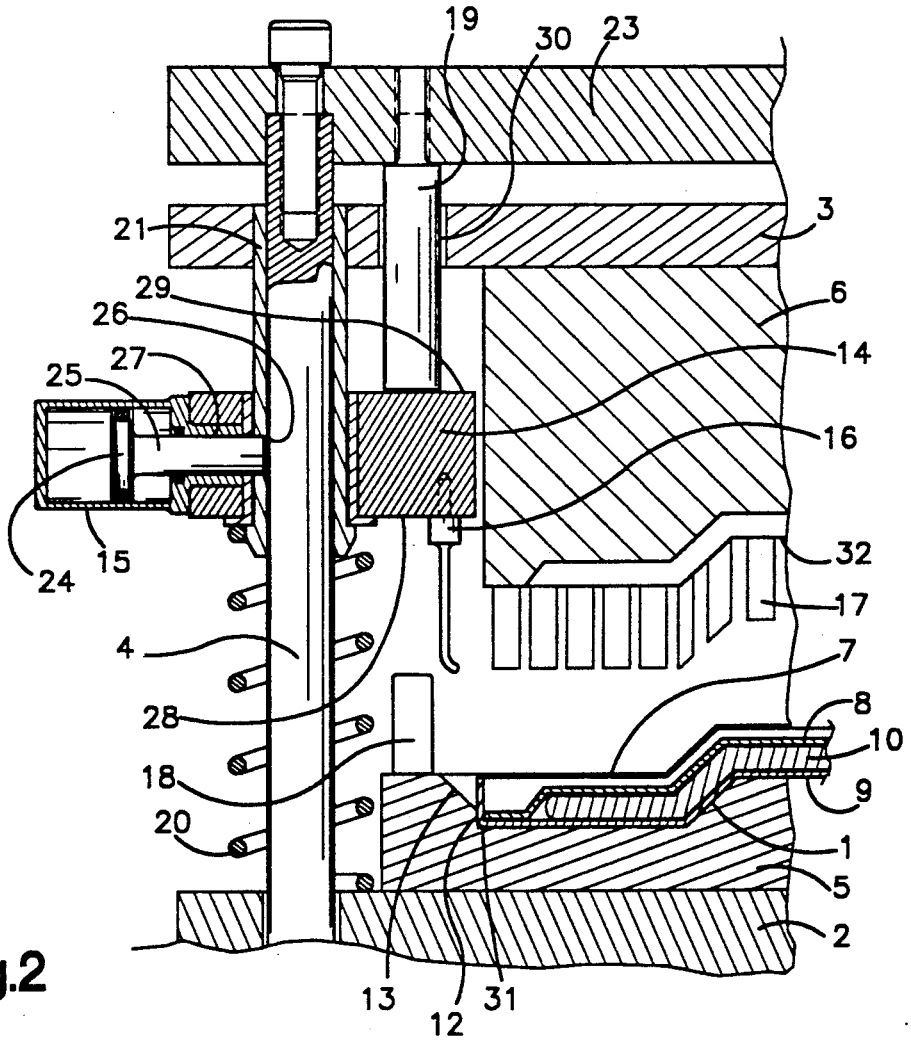
FIG. 2 shows a partial section through a pressing tool with the upper tool part at the upper dead point and a coupling engaged between frame and upper tool part.
Figure 3:
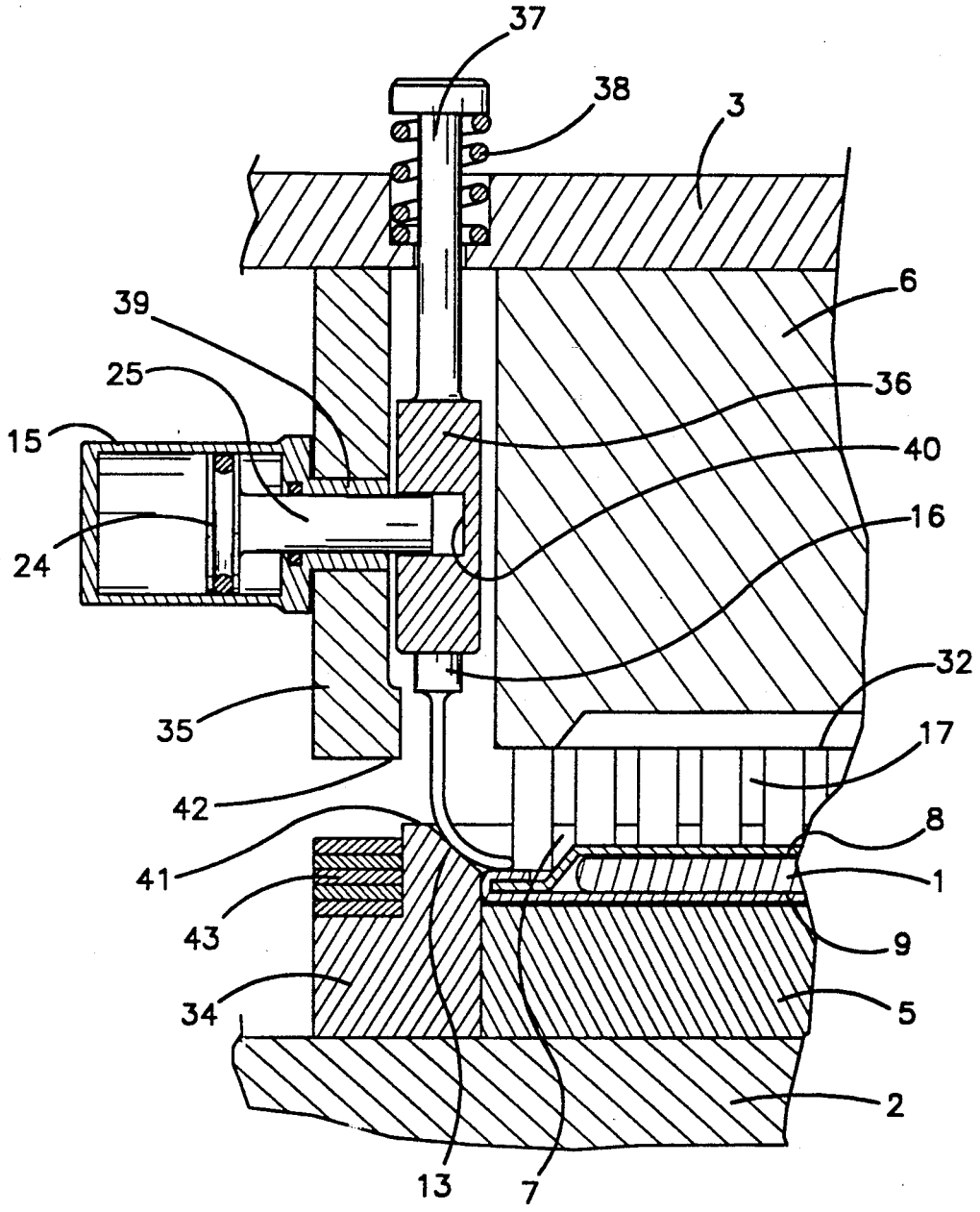
FIG. 3 shows a partial section through a pressing tool with a cutting plate and a cutting stamp for the cutting of formed plate edges, in which a coupling device joins the frame with the upper tool part, and the upper tool part is at the lower dead point after the folding over of the edge of the outer layer.

In FIG. 2, the tool according to FIG. 1 is shown in opened position after the end of the pressing process of the formed plate 1. Here, the upper part 3 of the tool is in the upper dead point. Above the upper part 3 of the tool is an opposite plate 23 into which stops 19 are fastened. Passages 30 for the stops 19 are arranged in the upper part 3 of the tool. In this position of the upper part 3 of the tool, an upper surface 29 of the frame 14 is pressed by the spring 20 against the stop 19. The stop 19 and the upper dead point position of the upper part 3 of the tool are so in accord with each other that the axis of the coupling pin 25 coincides with the axis of the coupling bore 26. In this way, the frame 14 is connected form-fitting with the upper part 3 of the tool and now follows every movement of the upper part 3 of the tool. The upper part of the tool is now run toward the lower part of the tool again until the free ends 17 of the spring elastic elements 16 arrive at the second side wall portion 13 of the forming hollow 7. Here the free ends 17 are turned against the erected rim portion of the second outer layer 9 of the formed plate 1. The erected edge portion lays over the edge portion of the first outer layer 8. This movement process is continued until the lower surface 28 of the frame 14 arrives at the stop 18, and thus the folding process is concluded. This end position of the spring elastic elements 16 is shown in FIG. 3. The stop 18 is not shown in FIG. 3, but is present there. The upper part 3 of the tool is now drawn back to the upper dead point, the piston-cylinder unit 24 is actuated again, and the coupling pin 25 is drawn out of the coupling bore 26 and returned to its starting position. For complete smoothing of the fold in the edge portions of the outer layers 8, 9 of the formed plate 1, the upper part 3 of the tool is closed again and the formed plate 1 completely pressed.

FIG. 3 shows a schematic arrangement of the edge portions of a pressing tool in the same work process in which the outer layer of the formed plate 1 to be folded over is cut. A cutting plate 34 with a cutting edge 41 is arranged around the die 5 with the forming hollow 7. On the upper part 3 of the tool is fastened a cutting stamp 35 which has a second cutting edge 42. The cutting plate 34 and the cutting stamp 35 are, in the example shown, arranged in ring form around the die 5 and the pressing stamp 6, respectively. Between the cutting stamp 35 and the pressing stamp 6 is the frame 36 to which are fastened the spring elastic elements 16. On the upper side of the frame 36 are arranged stops 37 with springs 38. In this arrangement, the springs 38 pull the frame 36 upward toward the upper part 3 of the tool with the coupling device 15 not engaged. Above the upper part 3 of the tool, there is also arranged a solid plate (not shown) with stops which cooperate with the stops 37. In FIG. 3, the upper part 3 of the tool with the pressing stamp 6 is in the end position after the ending of folding process. The outer layer nine of the formed plate is completely laid over. With this, the coupling pin 25 is engaged in a coupling bore 40 on the frame 36, and is guided in a bearing bushing 39 in the cutting stamp 35. The moving in and out of the coupling pin 25 takes place again through the piston-cylinder unit 24 and pressure medium feed lines and controls (not shown). In the tool arrangement shown, the individual layers of the formed plate 1 are laid, at the beginning of the work process, into the forming hollow 7. The second outer layer 9 again includes an aluminum foil and its edge projecting beyond the cut edge 41. Simultaneously with the pressing and forming of the formed plate 1, the edge portion of the second outer layer 9 is cut between the two cutting edges 41, 42. The cutting stamp 35 is moved, at the same time with the pressing stamp 6, toward the lower part 2 of the tool. Into the cutting plate 34 is laid an elastic support 43 which assures that the pressing stamp 6 can carry out the pressing movement with the necessary pressing force and without this movement being hindered by the cutting stamp 35. After the forming and cutting of the individual layers of the formed plate 1, the tool is completely opened as described in the arrangement according to FIGS. 1 and 2 until the upper part 3 of the tool is in the upper dead point. With this, the stops 37 strike against the limiting stops (not shown), and hold the frame 36 in a position at which the free ends 17 of the spring elastic elements 16 project above the end surfaces 32 of the pressing stamp 6. In this position, the coupling device 15 and its coupling pin 25 engage in the frame 36 and its coupling bore 40, respectively. Since the cutting stamp 35 is connected with the upper part 3 of the tool and thus with the pressing stamp 6, there is provided here again a form-fitting connection, and the frame 36 is moved downward by the upper part 3 of the tool or the pressing stamp 6. With this, the free ends 17 of the spring elastic elements 16 strike against the second side wall portion 13 of the forming hollow 7, lay the edge portion of the second outer layer 9 around the first outer layer 8, and produce an edge fold. To limit the movement of the upper part 3 of the tool, stops (not shown) are again built in here.

Figure 4:
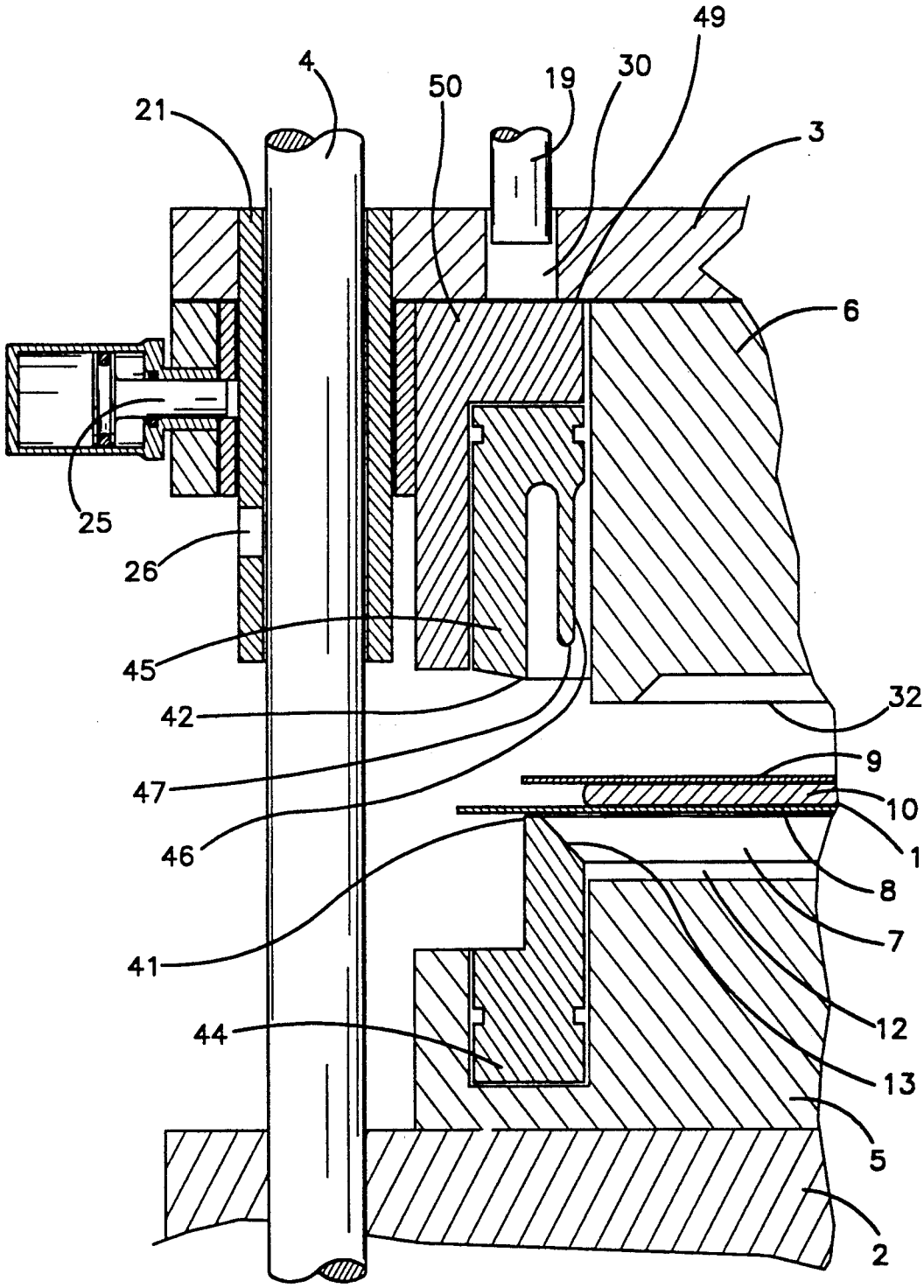
FIG. 4 shows a partial section through a pressing tool in the opened starting position, in which a cutting edge of a cutting device includes a plurality of cutting elements.

In FIG. 4, the frame 14 and the cutting stamp 35 shown in FIGS. 1 and 3 also form a frame-form construction unit 50. The cutting plate and the cutting stamp are formed in the zone of the cutting line and include a plurality of cutting elements 44, 45 lined up one after the other. The cutting elements 44, 45, have a polygonal cross-section, and in the example shown, a hexagonal cross-section. The cutting elements 44, 45 have cutting edges 41, 42 which are formed by the placing of step-form offsets. The cutting edges 41, 42 run from one angle of the hexagonal cross-section, through the center, to the angle of the hexagon lying opposite. The cutting elements 44, 45 formed in this way are lined up edge-to-edge, through which, in a simple way curved cutting lines can be formed. In the example shown, the die 5 with the integrated cutting elements 44, as well as the construction unit 50, consist of plastic. The cutting elements 44, 45 are cast into this plastic and thus form a form-fitting unit. With the cutting elements 45 are integrated fastened the spring elastic elements 46 with the free ends 47. By suitable working of the cutting elements 45, the spring elastic elements 46 might be made in one piece from the same material. The elements 44, 45 consist, in the example shown, of hardened spring steel.

The detail of the pressing tool in FIG. 4 shows the lower part 2 and the upper part 3 of the tool in the starting position before the beginning of the pressing process. Here, the multilayer plates 1 to be formed or their individual layers 8, 9, 10 are laid in as flat surfaces above the forming hollow 7. In the example shown, an aluminum plate 8 forms the outer layer which is to be folded over. This has the advantage that the aluminum foil 9 which forms the second outer layer is clamped fast between the aluminum plate 8. Thus, a very good joining results between the outer layers 8, 9. The exact outer contour of the outer layer 8 needed for this kind of production is produced by the fact that before the end of the forming process of the rim portion, the outer layer 8 is cut between the cutting edges 41, 42 of the cutting elements 44, 45. This is done during the pressing of the formed plate, while the tool still has the holding-down devices (not shown) for the outer layer 8. After the pressing and cutting of the formed plate 1, the upper part 3 of the tool is run into its upper dead point. During this movement cycle, the upper surface 49 of the construction unit 50 strikes against the stop 19 and is fixed in a position in which at the upper dead point of the upper part 3 of the tool, the coupling pin 25 can be engaged in the coupling bore 26. In this position, the free ends 47 of the spring elastic elements 46 stand above the end surfaces 32 of the pressing stamp 6. If the upper part 3 of the tool is run toward the lower part 2 of the tool again, the free ends 47 arrive at the second side wall portion 13, are turned at this surface toward the edge zone of the outer layer 8, set in the first work step during the pressing process against the first side wall portion 12, and lay this around the edge portion of the outer layer 9 to an edge fold. Since the spring elastic elements 46 in this form of execution include spring steel, aluminum plate can be worked directly with no problem. Here also, in another work step, after the uncoupling of the construction unit 50 from the upper part 3 of the tool, the edge zone of the formed plate 1 may be pressed completely.

The process for the operation of the pressing tool shown in FIGS. 1 to 4 includes a first work step in which the individual layers of plate to be formed are laid into the open tool between the lower part 2 and the upper part 3 of the tool. In the form of execution according to FIGS. 1 and 2, all layers are pre-cut to the right form. In the form of execution according to FIGS. 3 and 4, the outer layer, which is folded over, is cut in the tool driving the next work step, and may thus have a rather inexact outer form. In the next work step, the upper part of the tool is run toward the lower part 2 of the tool. By the pressing stamp 6, the individual layers 8, 9, 10 of the plate 1 to be formed, are pressed and formed in the forming hollow 7. Simultaneously with this pressing and forming process, the outer layer 8, 9 which is to form the fold, is drawn over the oblique side portion surface 13 of the forming hollow 7, and is set up between the side wall zone 12 and the wall surface 33 on the pressing stamp 6 perpendicular to the forming surface 11 of the forming hollow 7. The upper part 3 of the tool is now moved away from the lower part 2 of the tool and into its upper dead point. In the next work step by means of the coupling device 15, the frame 14, 36, 50 is joined with the upper part 3 of the tool and the pressing stamp 6, respectively. Then the two parts of the tool, 2, 3 are run together again, while the spring elastic elements 16, 46 are turned at the diverging zones of the forming hollow 7, or the side wall zone 13, and the edge of the one outer layer is laid, by the elastic elements 16, 46, completely around the edge of the other outer layer 8 or 9. The tool is now completely opened again, the frame 14, 36, 50 is uncoupled from the upper part 3 of the tool, and the tool is closed once more for a cleaner pressing of the edge portion of the formed plate 1. After opening the tool again, the formed plate 1 completely formed and folded in the edge portion can be removed, and without further finishing, sent on for use.

Having described a preferred embodiment of the invention, the following is claimed:

1. A pressing tool for producing a multilayer formed plate having at least two outer layers which form at least one overlapping border area, the pressing tool comprising:

a lower part including a die having a forming surface and first and second side wall portions of different inclinations relative to the forming surface, the first side wall portion adjoining the forming surface and extending approximately perpendicular to the forming surface, the second side wall portion adjoining the first side wall portion and diverging outwardly therefrom, the forming surface and the first and second side wall portions defining a mold cavity;

an upper part including a pressing stamp which fits into the mold cavity;

guide columns interconnecting the lower and upper parts;

a frame arranged coaxially around the pressing stamp and displaceable from a predetermined position relative to the pressing stamp, the frame having a bottom surface;

a coupling device for interlockingly connecting the frame and the pressing stamp together; and a plurality of spring elastic elements fastened to the bottom surface of the frame, each spring elastic element including a free end which engages the second side wall portion of the die of the lower part and then turns in a direction to fold an edge of one outer layer over an edge of another outer layer and thereby to form the at least one overlapping border area when the frame is displaced from the predetermined position relative to the pressing stamp.

2. The pressing tool according to claim 1 wherein the extent of movement of the frame in an opening direction away from the die is limited by stops, the free ends of the spring elastic elements projecting beyond an end surface of the pressing stamp when the pressing stamp is at an upper dead center position, the upper dead center position of the pressing stamp corresponding to a position at which the pressing stamp reverses its direction of motion after the pressing stamp has moved in the direction away from the die, the coupling device interlockingly connecting the frame and the pressing stamp together when the pressing stamp is at the upper dead center position.

3. The pressing tool according to claim 1 wherein the spring elastic elements include a plurality of rod-shaped strips disposed adjacent to one another.

4. The pressing tool according to claim 1 wherein the spring elastic elements are made of metal.

5. The pressing tool according to claim 1 wherein the spring elastic elements are made of plastic.

6. A pressing tool for producing a multilayer formed plate having at least two outer layers which form at least one overlapping border area, the pressing tool comprising:

a lower part including a die having a forming surface and first and second side wall portions of different inclinations relative to the forming surface, the first side wall portion adjoining the forming surface and extending approximately perpendicular to the forming surface, the second side wall portion adjoining the first side wall portion and diverging outwardly therefrom, the forming surface and the first and second side wall portions defining a mold cavity;

an upper part including a pressing stamp which fits into the mold cavity;

guide columns interconnecting the lower and upper parts;

a frame arranged coaxially around the pressing stamp and displaceable from a predetermined position relative to the pressing stamp, the frame having a bottom surface;

a coupling device for interlockingly connecting the frame and the pressing stamp together; and a plurality of spring elastic elements fastened to the bottom surface of the frame, each spring elastic element including a free end which engages the second side wall portion of the die of the lower part and then turns in a direction to fold an edge of one outer layer over an edge of another outer layer and thereby to form the at least one overlapping border area when the frame is displaced from the predetermined position relative to the pressing stamp;

the lower part including a cutting plate arranged around the mold cavity, the upper part including a cutting stamp arranged around the pressing stamp, the frame and the spring elastic elements being guided between the pressing stamp and the cutting stamp.

7. The pressing tool according to claim 6 wherein the cutting plate and the cutting stamp include a plurality of individual cylindrical cutting elements which are polygonal in cross-section, a cutting element of the cutting plate and a cutting element of the cutting stamp in each case forming a pair having cutting edges directed toward each other.

8. The pressing tool according to claim 7 wherein the spring elastic element are arranged on the cutting stamp.

9. A pressing tool for producing a multilayer formed plate having at least two outer layers which form at least one overlapping border area, the pressing tool comprising:

a lower part including a die having a forming surface and first and second side wall portions of different inclinations relative to the forming surface, the first side wall portion adjoining the forming surface and extending approximately perpendicular to the forming surface, the second side wall portion adjoining the first side wall portion and diverging outwardly therefrom, the forming surface and the first and second side wall portions defining a mold cavity;

an upper part including a pressing stamp which fits into the mold cavity;

guide columns interconnecting the lower and upper parts;

a frame arranged coaxially around the pressing stamp and displaceable from a predetermined position relative to the pressing stamp, the frame having a bottom surface;

a coupling device for interlockingly connecting the frame and the pressing stamp together;

a plurality of spring elastic elements fastened to the bottom surface of the frame, each spring elastic element including a free end which engages the second side wall portion of the die of the lower part and then turns in a direction to fold an edge of one outer layer over an edge of another outer layer and thereby to form the at least one overlapping border area when the frame is displaced from the predetermined position relative to the pressing stamp; and springs connecting the frame, the springs pressing the frame against the upper part.

* * * * *